US007690087B2

(12) United States Patent
Morishita et al.

(10) Patent No.: US 7,690,087 B2
(45) Date of Patent: Apr. 6, 2010

(54) BUTTON

(75) Inventors: Akira Morishita, Kurobe (JP); Yoshio Takamura, Kurobe (JP); Hiroko Mikado, Kurobe (JP); Yasuharu Yoshimura, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 12/366,256

(22) Filed: Feb. 5, 2009

(65) Prior Publication Data

US 2009/0144946 A1 Jun. 11, 2009

Related U.S. Application Data

(63) Continuation of application No. PCT/JP2007/065260, filed on Aug. 3, 2007.

(30) Foreign Application Priority Data

Aug. 7, 2006 (JP) ..... 2006-214408

(51) Int. Cl.
*A44B 1/28* (2006.01)
*A44B 1/42* (2006.01)

(52) U.S. Cl. ..... 24/95

(58) Field of Classification Search ..... 24/94, 24/95, 114.4; 29/4
See application file for complete search history.

(56) References Cited

U.S. PATENT DOCUMENTS 1,378,108 A 5/1921 Hart et al.
1,463,236 A 7/1923 White
1,800,767 A * 4/1931 White et al. ..... 24/95

FOREIGN PATENT DOCUMENTS

EP 97302 A1 * 1/1984
JP 59-232501 A 12/1984
JP 60 083406 (U) 6/1985
JP 61 052909 (U) 4/1986
JP 2004-250760 A 9/2004

OTHER PUBLICATIONS

International Search Report of corresponding Application No. PCT/JP2007/065260, mailed Aug. 28, 2007.

* cited by examiner

*Primary Examiner*—James R Brittain
(74) *Attorney, Agent, or Firm*—Alston & Bird, LLP

(57) ABSTRACT

A button comprises a button body (10, 10*a*, 10*b*) and a prong (20, 20*a*, 20*b*) adapted to be arranged on the side of cloth (30) opposite to the side thereof on which the button body mentioned above is set in place to nip the cloth therebetween and to fixedly secure the button body to the cloth. The button body mentioned above contains an outer shell member (13), which comprises a button back (15, 15*a*, 15*b*) and a cap (14, 14*a*, 14*b*), and an insert (11, 11*a*, 11*b*) accommodated in the outer shell member. In order to make a whitish button which could be heretofore obtained only by plating, at least the button back mentioned above is made of aluminum or an aluminum alloy. Preferably, the button back mentioned above is made of an aluminum alloy containing 3-6% by weight of magnesium, and the cross-sectional thickness of the above-mentioned button back is in the range of 0.25-0.6 mm. Further, it is desirable that the above-mentioned cap and the insert should also be made of an aluminum alloy.

3 Claims, 2 Drawing Sheets

BUTTON

CROSS-REFERENCE TO RELATED APPLICATIONS

This is a continuation of Application PCT/JP2007/065260, filed Aug. 3, 2007, which, was published under PCT Article 21(2).

BACKGROUND OF THE INVENTION

1. Field of the Invention

This invention relates to a button made of metal, and particularly to a button of which at least a button back is manufactured from aluminum or an aluminum alloy in order to manufacture the button at low cost and simply.

2. Description of the Prior Art

A button of the type in which a fastener called a prong having projected leg members pierces cloth to which a body of the button is attached from the back of the cloth and these leg members are fixedly secured to the button body to attach the button to the cloth is known from old times, as disclosed in U.S. Pat. No. 1,463,236 and U.S. Pat. No. 1,378,108. In the case of a metal button, generally such type of button is adopted.

The conventional metal buttons include, for example, a button 1 which comprises a button body 10 containing an insert (accommodated member) 11 surrounded by an outer shell member 13 consisting of a cap 14 and a button back 15 and a fastener 20 called a prong (tack) to be arranged so as to nip the cloth 30 between the button body and the fastener and having two leg members 21, as shown in FIG. 1 and FIG. 2, wherein the button is attached to the cloth by making the prong 20 to pierce the cloth 30 so as to make a hole in the bottom of the button back 15 and simultaneously to be bent (curled) by the aid of a curved surface of a recess 12 of the insert 11 so that it is fixedly secured to the button body 10 (hereinafter referred to as a metal button (A)); and a button 1*a* which comprises a button body 10*a* containing an insert 11*a* made of resin of which upper and side surfaces are surrounded by an outer shell member consisting of a cap 14*a* and a button back 15*a* and a prong (tack) 20*a* having a single leg member 21*a* of the arrowhead shape, which is to be arranged so as to nip the cloth between the button body and the prong, as shown in FIG. 3, wherein the button is attached to the cloth 30 by making the prong 20*a* to pierce the cloth 30 and press-fitting the arrowhead-like leg member 21*a* into a hole 12*a* of the insert 11*a* made of resin so that it is fixedly secured to the button body by the aid of the anchor effect of its leading end (hereinafter referred to as a metal button (B)).

In both the metal button (A) and the metal button (B), the above-mentioned caps 14 and 14*a* which have been used are either one of the followings:

(1) the cap manufactured by cold pressing a linear material of a copper-zinc alloy to a predetermined shape and subjecting it to various plating treatments from the viewpoint of its design, (2) the cap manufactured by cold pressing a linear material of an aluminum alloy to a predetermined shape and subjecting it to an alumite treatment (an anodic oxidation treatment) from the viewpoint of its design, and (3) the cap manufactured by cold pressing a linear material of stainless steel to a predetermined shape.

The inserts 11 and 11*a* are the parts to be built into the inside of the button body for the purpose of absorbing the shock at the time of attachment of the button, guiding the leading end parts of the prong leg members at the time of bending (curling) thereof, and preventing the prong leg members from being left out. In the case of the metal button (A), either of (1) the insert manufactured by cold casting iron or low-carbon steel into a predetermined shape or (2) the insert manufactured by molding a zinc alloy into a predetermined shape by die casting has been used. On the other hand, in the case of the metal button (B), the insert manufactured by injection molding a resin into a predetermined shape has been used.

Furthermore, in both the metal button (A) and the metal button (B), the button backs 15 and 15*a* which have been used are either of (1) the button back manufactured by cold pressing a plate material of a copper-zinc alloy to a predetermined shape and subjecting it to a silver white plating treatment from the viewpoint of its design or (2) the button back manufactured by cold pressing a linear material of stainless steel of which alloy color tone is silver white to a predetermined shape.

Generally a metal button is attached to such cloth as jeans and trucker jackets or denim jackets. Most of the button backs have the color tone of silver white so as to make a high-grade impression etc. on people. In order to secure the required fixing strength so that the above-mentioned button back may certainly not come off the cloth after completion of attachment thereof to the cloth by the aid of the prong, either of (1) a copper-zinc alloy subjected to silver white plating or (2) stainless steel having the alloy color tone of white is used. However, since the above material (1) has the alloy color tone of yellow, the high-grade impression is inferior to the whitish materials. Accordingly, the above material should be subjected to a silver white plating treatment to produce the high-grade impression. However, the plating treatment increases the working steps and will exert a harmful influence on a human body depending on the kind of plating. Moreover, there is a possibility of polluting environment due to a waste water treatment, for example, accompanying the plating treatment (environment load is large). On the other hand, as for the above material (2), since the alloy color tone of stainless steel material is silver white, there is no need to purposely perform the plating treatment of silver white. However, since its workability of cold pressing is inferior to a copper-zinc alloy, the life of a pressing mold is short, which requires frequent exchange of the metal molds, and the load exerting on environment is large.

SUMMARY OF THE INVENTION

The present invention has been made to solve the problems of the conventional technology as described above and has an object to provide a button which can be manufactured simply and at low cost by a method of plating-free, particularly a whitish button which could be heretofore obtained only by plating.

To accomplish the above-mentioned object, the present invention provides a button which comprises a button body and a fastener adapted to be arranged on the side of cloth opposite to the side thereof on which the button body is set in place to nip the cloth therebetween and to fixedly secure the button body to the cloth, the button body mentioned above containing an outer shell member, which comprises a button back and a cap, and an insert accommodated in the outer shell member, characterized in that at least the button back mentioned above is made of aluminum or an aluminum alloy.

In a preferred embodiment, the button back mentioned above is made of an aluminum alloy containing 3-6% by weight of magnesium, and the cross-sectional thickness of the above-mentioned button back is in the range of 0.25-0.6 mm. In a more preferred embodiment, the Vickers hardness of a side portion of the button back mentioned above is Hv 110-140, and the Vickers hardness of a portion of the button back with which the prong mentioned above comes into contact is Hv 80-105.

Furthermore, it is desirable that the above-mentioned cap and the insert should also be made of an aluminum alloy.

According to the present invention, since the button back portion is formed from aluminum or an aluminum alloy, it is possible to provide a whitish button back, which has heretofore been obtained only by plating, by a plating-free method. Consequently, a button can be manufactured simply and at low cost, without requiring the conventional plating process and the liquid waste treatment accompanying the plating treatment and without producing the problem of environmental pollution. Moreover, since aluminum or an aluminum alloy has high ductility, the button back excels in the shock absorption properties when the fastener is attached thereto and the bottom thereof will not be cracked.

Furthermore, according to the preferred embodiment of the present invention, since the button back mentioned above is made of an aluminum alloy containing 3-6% by weight of magnesium and the cross-sectional thickness of the above-mentioned button back is in the range of 0.25-0.6 mm, it is possible to secure sufficient strength. In a more preferred embodiment, since the Vickers hardness of a side portion of the button back mentioned above is Hv 110-140 and the Vickers hardness of a portion of the button back with which the prong mentioned above comes into contact is Hv 80-105, the fastener can be attached to the bottom of the button back without causing cracks therein and also without producing deformation in the side portion of the button back, and it is therefore possible to provide a button excelling in reliability. Further, by manufacturing the above-mentioned cap and the insert from an aluminum alloy, it is possible to attain weight-saving of the produced button and to provide the button excelling in recycling efficiency because of not requiring separation and selection of parts when recycled.

BRIEF DESCRIPTION OF THE DRAWINGS

Other objects, features, and advantages of the invention will become apparent from the following description taken together with the drawings, in which.

DETAILED DESCRIPTION OF THE PREFERRED EMBODIMENTS

In accordance with the present invention, in a button which comprises a button body and a fastener adapted to be arranged on the side of cloth opposite to the side thereof on which the button body is set in place to nip the cloth therebetween and to fixedly secure the button body to the cloth, the button body mentioned above containing an outer shell member, which comprises a button back and a cap, and an insert accommodated in the outer shell member, by forming at least the button back from aluminum or an aluminum alloy, it has made possible to provide a whitish button back, which has heretofore been obtained only by plating, by a plating-free method.

Now, some examples of the metal button to which the present invention can be suitably applied will be described with reference to the accompanying drawings. Thereafter, the details of the components will be described in detail.

Figure 1:
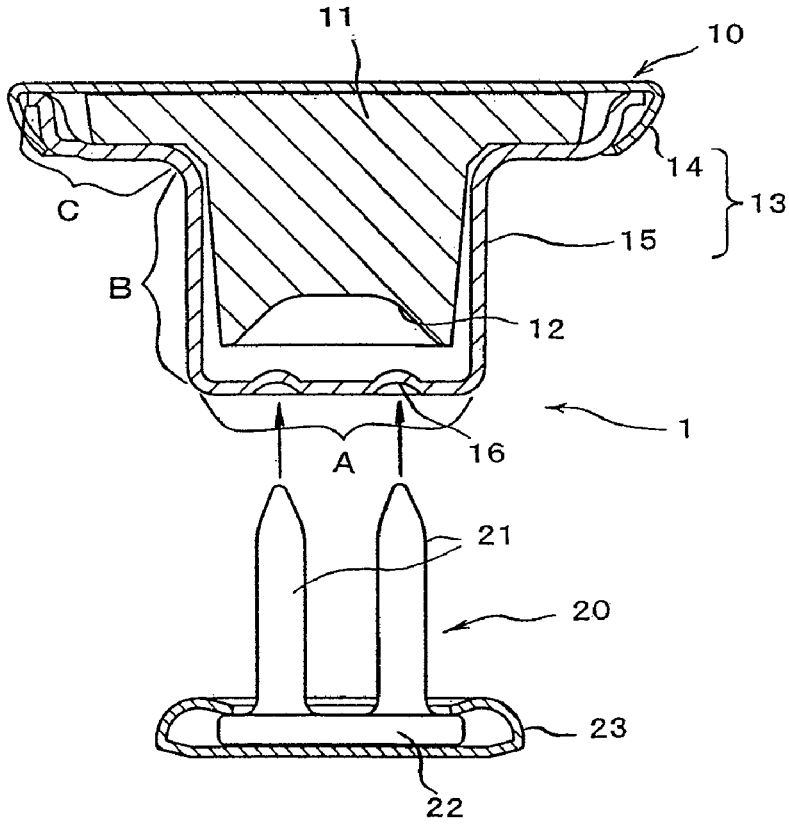
FIG. 1 is an exploded cross-sectional view illustrating an example of a metal button to which the present invention is applied.
Figure 2:
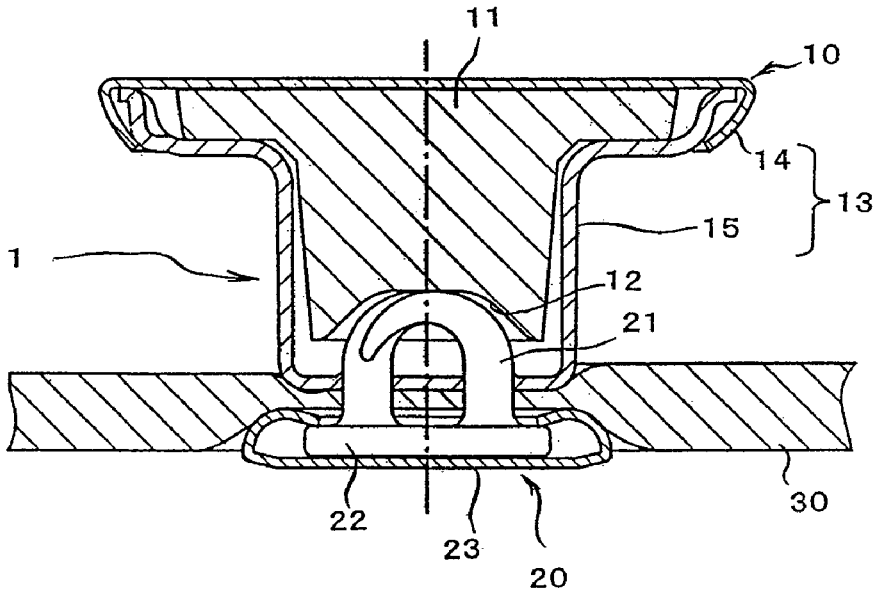
FIG. 2 is a cross-sectional view illustrating the state where the metal button shown in FIG. 1 is attached to the cloth and assembled.

FIG. 1 and FIG. 2 show the metal button (A) mentioned above. This button 1 consists of a button body 10, which comprises an insert (accommodated member) 11 having an upper portion extended in the shape of a disk and an outer shell member 13 which comprises a button back 15 surrounding the insert and a cap 14 disposed thereon so as to cover them, and a fastener 20 called a prong (tack) which has two leg members 21 and is to be arranged on opposite side of the cloth 30 so as to nip the cloth between the button body and the fastener. The button back 15 consists of a disk-like bottom "A", a cylindrical side portion "B" raised from the circumferential edge of the bottom "A" mentioned above, and an annular upper dish-like portion "C" which is laterally extending in the radial direction from the upper end of the side portion "B" mentioned above and has a side portion raised upward so as to surround the upper portion of the insert 11 mentioned above extending in the shape of a disk. The insert (accommodated member) 11 has a recess 12 which is formed in the bottom thereof and functions as a guiding part for bending (curling) the leading end portion of the prong 20 when the leg members 21 of the prong 20 pierce the button back. Further, the button back 15 has two depressed areas 16 which are formed in the bottom "A" thereof and function as guiding parts when the two leg members 21 of the prong 20 are pushed to pierce the button back. On the other hand, the prong 20 has a pair of leg members 21 raised from a disk-like base 22, and the circumference of the base 22 is covered with a cap 23. When this button 1 is attached to the cloth 30, the prong 20 arranged on the side of cloth 30 opposite to the side thereof on which the button body 10 is set in place so as to nip the cloth therebetween is pushed therein. Consequently, two leg members 21 pierce the cloth 30, make holes in the depressed areas 16 of the bottom "A" of the button back 15 and simultaneously are bent (curled) by the aid of a curved surface of the recess 12 of the insert 111, as shown in FIG. 2, so that it is fixedly secured to the button body 10. In this way the button can be attached to the cloth 30.

Figure 3:
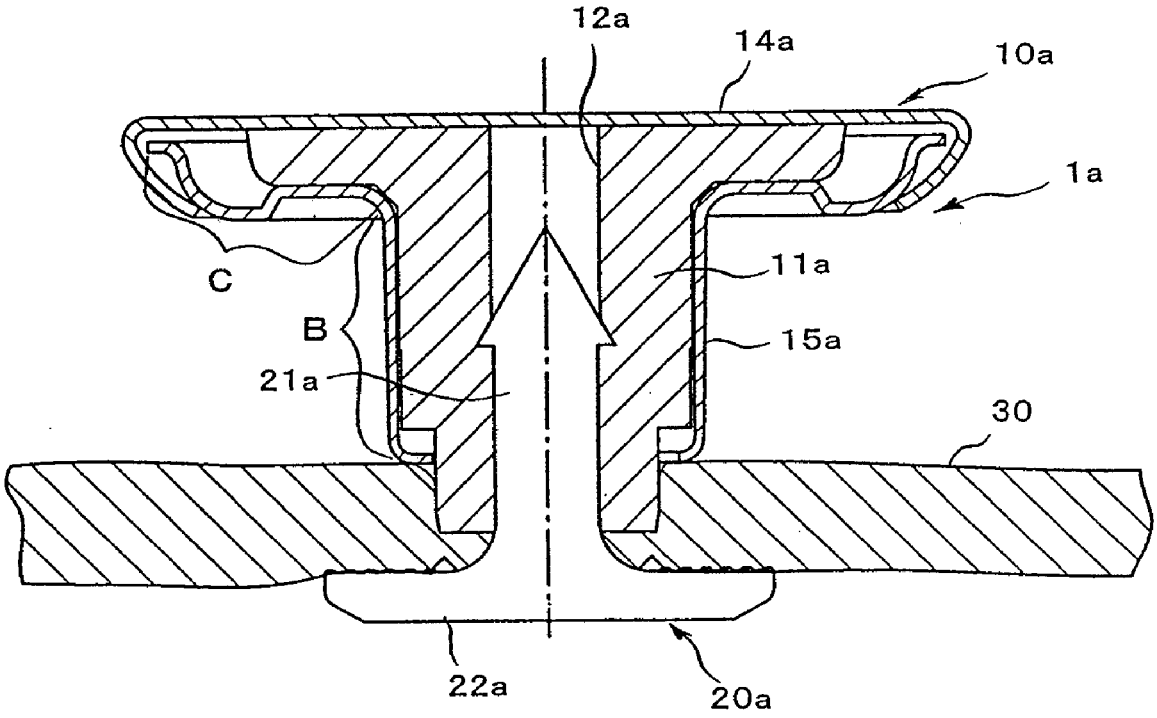
FIG. 3 is a cross-sectional view illustrating another example of the metal button to which the present invention is applied in the state where it is attached to the cloth and assembled.

FIG. 3 shows the metal button (B) mentioned above. This button 1*a* consists of a button body 10*a*, which comprises an insert 11*a* made of resin and having an upper portion extended in the shape of a disk and an outer shell member comprising a cap 14*a* and a button back 15*a* and surrounding the upper part and the side of the insert respectively, and a prong 20*a* which is to be arranged on the opposite side of the cloth so as to nip the cloth between the button body and the prong and has a single leg member 21*a* of the arrowhead shape. The button back 15*a* consists of a cylindrical side portion "B" having no bottom portion and an annular upper dish-like portion "C" which is laterally extending in the radial direction from the upper end of the side portion "B" mentioned above and has a curved side portion raised upward so as to surround the upper portion of the insert 11 mentioned above extending in the shape of a disk. Incidentally, although the annular upper dish-like portion "C" has a step portion formed between the portion laterally extending in the radial direction and the curved side portion raised upward, it may be flat like the upper dish-like portion "C" of the button back 15 shown in FIG. 1 and FIG. 2. The insert 11*a* made of resin has a hole 12*a* formed therein so as to vertically run therethrough and its bottom is exposed. On the other hand, the prong 20*a* has such a form that a single leg member 21*a* of the arrowhead shape is raised from the center of a disk-like base 22*a*. When this button 1*a* is attached to the cloth 30, the prong 20*a* arranged on the side of the cloth 30 opposite to the side thereof on which the button body 10*a* is set in place so as to nip the cloth therebetween is pushed therein. Consequently, the leg member 21*a* of the arrowhead shape pierces the cloth 30 and is press-fitted into the hole 12*a* of the insert 11*a* made of resin, as shown in FIG. 3, so that the button can be attached to the cloth 30 by the aid of the anchor effect of the leading end of the leg member.

Figure 4:
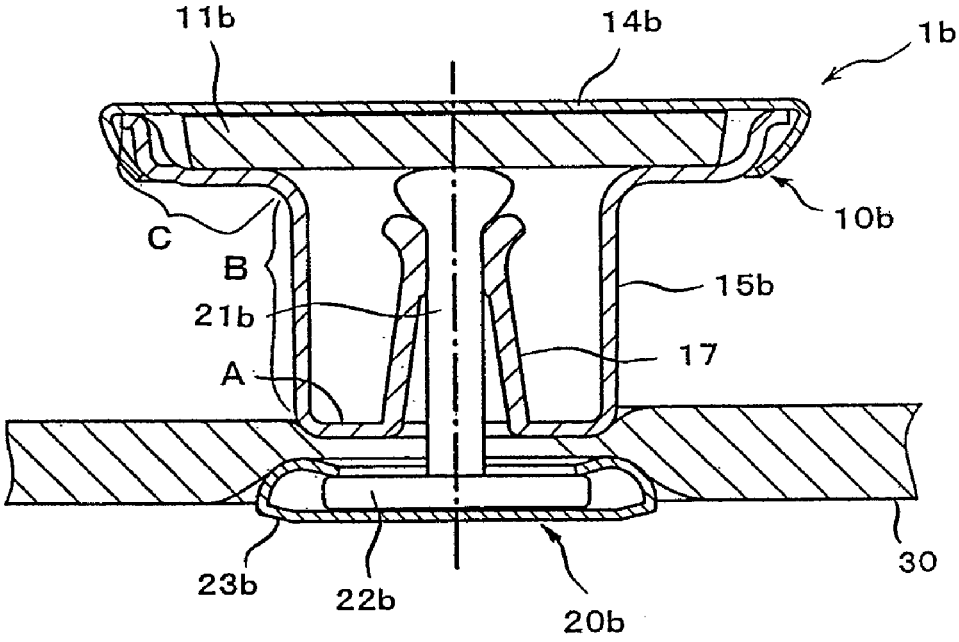
FIG. 4 is a cross-sectional view illustrating still another example of the metal button to which the present invention is applied in the state where it is attached to the cloth and assembled.

FIG. 4 shows an example of another metal button. This button 1*b* consists of a button body 10*b*, which comprises a button back 15*b*, a disk-like insert 11*b* laid on the upper extending portion of the button back, and a cap 14*b* disposed thereon so as to cover the upper parts thereof, and a prong (tack) 20*b* which has a single leg member 21*b* and is to be arranged on opposite side of the cloth so as to nip the cloth between the button body and the prong. Although upwardly tapering split cylindrical guide parts 17 are raised from the flat ring-like bottom "A" of the button back 15*b* in the upward direction from the circumferential edge of its center hole to the cap 14*b*, other structure is the same as that of the button back 15 shown in FIG. 1 and FIG. 2. On the other hand, the prong 20*b* has such a form that a single leg member 21*b* having a leading end bulge portion is raised from the center of a disk-like base part 22*b* and the circumference of the base 22*b* is covered with a cap 23*b*. When this button 1*b* is attached to the cloth 30, the prong 20*b* arranged on the side of the cloth 30 opposite to the side thereof on which the button body 10*b* is set in place so as to nip the cloth therebetween is pushed therein. Consequently, the leg member 21*b* pierces the cloth 30 and is press-fitted into the guide part 17 of the button back 15*b*, as shown in FIG. 4, so that the button can be attached to the cloth 30 by the aid of the detachment preventing effect of the leading end bulge portion of the leg member.

Next, respective component parts of the metal buttons mentioned above will be described hereinbelow.

(1) Cap:

Although the component made of a Cu—Zn alloy or a zinc alloy which had been subjected to a decorative treatment is generally used as the cap (14, 14*a*, 14*b*) of the button body, it is not limited to a particular one.

(2) Insert:

In the case of the metal button shown in FIG. 1 and FIG. 2, the insert 11 is a member for carrying out the curling of the leg members 21 of the prong 20 and fixedly securing the button to the cloth. Accordingly, iron or low-carbon steel which has the predetermined strength and has been subjected to zinc plating or a zinc alloy is used for the portion (recess 12 in the bottom) which comes into contact with the leg members 21 of the prong 20. However, any material may be used insofar as it makes the curling of the leg members 21 of the prong 20 possible. Particularly preferred insert of the present invention is manufactured from an aluminum alloy, which makes possible to provide a recyclable button with lightweight. Further, since the button back 15 and the insert 11 are formed of the material of the same quality, it makes possible to provide a button which will not cause potential difference corrosion due to the contact of the insert with the button back, which had heretofore often come into question.

Incidentally, when the insert is manufactured from an aluminum alloy like the present invention, attention should be directed to the following points.

Since the insert is made of an aluminum alloy, the required hardness will not be obtained if the insert is manufactured by a die casting method which has been used heretofore. Therefore, the insert is manufactured by the cold working of an aluminum alloy. For example, it is desirable that an aluminum alloy containing a predetermined amount of magnesium be subjected to the cold working to form a product of a predetermined shape having the Vickers hardness of not less than Hv 90. It is more preferable to manufacture the insert of which portion (dome-like recess 12) coming into contact with the prong 20 (fastener) has the Vickers hardness of not less than Hv 110. As a result, the insert will have high fixing strength and will be hardly corroded. Incidentally, if the Vickers hardness is lower than Hv 90, the leg member 21 of the prong 20 will not be firmly curled, which results in insufficient fixing strength. Incidentally, since the upper limit of the Vickers hardness is restricted to about Hv 150 in view of the properties of an aluminum alloy, the proper range is from Hv 90 to Hv 150 if the upper limit is taken into consideration.

In case the insert is made of an aluminum alloy, since the magnesium content therein exerts an influence on the form and the size of the insert after the cold pressing, particularly exerts a great influence on the attachment of a metal button. Accordingly, it is desirable that the aluminum alloy used for the insert should contain magnesium in the range of 3% to 6% by weight. If the magnesium content is less than 3% by weight, the degree of work-hardening at the time of the cold pressing will become low and a predetermined hardness will not be obtained after molding. As a result, it will be hardly possible to attach the button to the cloth securely by taking advantage of the curling of the prong. Conversely, if the magnesium content is more than 6% by weight, the resultant alloy will exhibit inferior cold forming properties. As a result, the obtained insert tends to generate cracks when the button body is attached to the cloth by the use of the prong. Furthermore, the insert tends to generate stress corrosion cracking and its corrosion resistance will become inferior.

In the case of the metal button shown in FIG. 3, since the insert 11*a* fixes the button to the cloth firmly by strongly fixing the leg member 21*a* of the arrowhead shape of the prong 20*a* to its hole 12*a*, the insert made of a synthetic resin is used.

On the other hand, in the case of the metal button shown in FIG. 4, the insert 11*b* may be a flat plate.

(3) Button Back:

The button back (15, 15*a*, 15*b*) is a member which constitutes an outer shell of a button and adapted to contain the insert (11, 11*a*, 11*b*) therein. Since the button back of the present invention is made of aluminum or an aluminum alloy, unlike the conventional one, it is not required to be subjected to white plating.

In case the button back is made of an aluminum alloy, since the magnesium content therein exerts an influence on the form and the size of the button back after the cold pressing, particularly exerts a great influence on the attachment of a metal button. Accordingly, it is desirable that the aluminum alloy used for the button back should contain magnesium in the range of 3% to 6% by weight. If the magnesium content is less than 3% by weight, the degree of work-hardening at the time of the cold pressing will become low and a predetermined hardness will not be obtained after molding. Specifically, in the case of the metal button (A) shown in FIG. 1 and FIG. 2, it will be difficult to obtain the fixing strength equal to or more than that of the present button back, so that a button will come off the cloth when the button is used. Moreover, when the metal button (A) is attached to the cloth by means of the fastener (prong), its shock will deform the side portion of the button back and impair its design. Similarly, in the case of the metal button (B) shown in FIG. 3, when the fastener (prong) is attached to the insert made of resin, its shock will deform the side portion of the button back.

Conversely, if the magnesium content is more than 6% by weight, the resultant alloy will exhibit inferior cold forming properties. As a result, in both the metal button (A) and the metal button (B) the button back tends to generate cracks when it is attached to the cloth by the use of the fastener (prong). Moreover, the button back tends to generate stress corrosion cracking and its corrosion resistance will become inferior.

Next, the cross-sectional thickness of the button back (15, 15*a*, 15*b*) will be described.

Since the cross-sectional thickness after the cold pressing exerts a great influence on the form and the size of the button back and also on the attachment of the metal button (A). Accordingly, it is desirable that the cross-sectional thickness of the button back be in the range of 0.25 to 0.6 mm. If the cross-sectional thickness is smaller than 0.25 mm, it will be difficult to obtain the fixing strength equal to or more than that of the present button back. Moreover, when the metal button is attached to the cloth by means of the fastener (prong), its shock will deform the side portion of the button back and impair its design. Similarly, in the case of the metal button (B), when the fastener is attached to the insert made of resin, its shock will deform the side portion of the button back.

Conversely, if cross-sectional thickness is larger than 0.6 mm, in the case of the metal button (A) the penetration characteristics of the leg member will become inferior when the button is attached to the cloth by the use of the fastener (prong) having two leg members made of a copper-zinc alloy. As a result, it will be difficult to obtain the fixing strength equal to or more than that of the present button back. Further, in both the metal button (A) and the metal button (B), the size of the button becomes large, which will impair its design and lead to an increase in cost. In order to secure sufficient fixing strength, the cross-sectional thickness of the button back is desired to be such size that the thickness of the bottom "A" is smaller than those of the upper dish-like portion "C" and the side portion "B".

Then, the hardness of the button back (15, 15*a*, 15*b*) will be described.

In the case of the metal button (A) shown in FIG. 1 and FIG. 2, the hardness of the bottom of the button back 15, i.e. the portions (depressed areas 16) through which the prong 20 contacts and penetrates, has a close relation to the fixing strength of the metal button (A). If the Vickers hardness is in the range of Hv 80 to 105, it is possible to obtain the fixing strength equal to or more than that of the present button back. However, if the hardness is lower than the above range, the fixing strength of the button will become low and there is a possibility that the button may come off the cloth when the button is used. Conversely, if the hardness is higher than the above range, when the button is attached to the cloth by the use of the fastener (prong) having leg members, cracks will occur in the bottom of the button back due to the insufficient ductility of the bottom of the button back and the fixing strength of the metal button (A) will become low. As a result, the button tends to come off the cloth.

Further, since the side portion "B" and the upper dish-like portion "C" exposed in the side of the button back (15, 15*a*, 15*b*) of the present invention are the portions exposed outside when it is attached to the cloth, their hardness, particularly the hardness of the side portion "B" has a close relation to the design (form and size) of the metal button. If their hardness, at least the hardness of the side portion "B" in Vickers hardness is not less than Hv 110 and not more than Hv 140, preferably in the range of Hv 110-130, all of the metal button (A) shown in FIG. 1 and FIG. 2, the metal button (B) shown in FIG. 3, and the metal button shown in FIG. 4 will withstand the pressing force when the prong has abutted against the bottom of the button back at the time of attachment, thereby causing no deformation in the side portion of the button back. However, if the hardness is lower than Hv 110, the button back will deform with the shock at the time of attachment to the cloth. Conversely, if the hardness is higher than Hv 140, there is a possibility of causing cracks in the side of the button back when the button back is attached to the cloth by the use of the prong and impairing its design.

Finally, the fastener (prong) will be described.

The prong (20, 20*a*, 20*b*) is a member used for attaching the button to the cloth. For example, those having the structures shown in FIG. 1 through FIG. 4 may be cited. When the button having the form shown in FIG. 1 and FIG. 2 is used, since it is attached to the cloth by curling the leg members 21 of the prong 20 by the aid of the dome-like recess 12 formed in the insert 11, a material having a certain degree of strength and exhibiting high ductility, such as a Cu—Zn alloy and a stainless steel alloy, for example, is used as a material thereof.

Further, in the case of the button having the form shown in FIG. 3 or FIG. 4, the prong is required to be press-fitted into the hole 12*a* formed in the insert 11*a* made of resin or into the split cylindrical guide part 17 raised from the central part of the insert 11*b* while deforming it for attachment to the cloth, a material such as an aluminum alloy, for example, is used as a material thereof.

EXAMPLES

Now, the working examples and comparative examples which have concretely confirmed the effect of the present invention will be described. It is natural, however, that the present invention is not limited to the following Examples.

Example 1

Manufacture of Metal Button (A)

A linear A5182 aluminum alloy material, 0.45 mm in thickness and the tempering condition of O-material (the most soft state, which had been subjected to an annealing treatment), was subjected to the cold pressing with a pressing machine to manufacture a button back as shown in FIG. 1. Thereafter, a button was assembled using a cap made of brass and an insert made by zinc die casting by means of a button back assembly machine and attached to cloth by the use of a prong made of a Cu—Zn alloy. The hardness distribution measured with a Vickers hardness tester and the fixing strength of the obtained button were evaluated in such manner that the button which showed the strength equal to the strength obtained from the metal button using the conventional button back was rated as ○ and the button which showed the strength lower than the strength obtained from the metal button using the conventional button back was rated as X. Further, the presence or absence of deformation thereof at the time of attachment to the cloth was visually examined. The results are shown in Table 1.

Example 2

Manufacture of Metal Button (B)

A linear A5182 aluminum alloy material, 0.3 mm in thickness and the tempering condition of O-material, was subjected to the cold pressing with a pressing machine to manufacture a button back. Thereafter, a button was assembled using a cap made of brass and an insert made of resin by means of a button back assembly machine and attached to cloth by the use of a prong made of an aluminum alloy. The hardness distribution and the fixing strength of the obtained button were evaluated in the same manner as the above-mentioned metal button (A). Further, the presence or absence of deformation thereof at the time of attachment to the cloth was visually examined. The results are collectively shown in Table 1.

TABLE 1

| | | Thickness of linear material (mm) | Thickness after cold pressing (mm) | | Hardness of Button Back (Hv) | | Fixing Strength | Deformation at the time of attachment |
|---|---|---|---|---|---|---|---|---|
| | | | Bottom | Side | Side B | Prong contact portion | | |
| Example 1 | Button A | 0.45 | 0.3 | 0.4 | 110-138 | 94-105 | ○ | Absence |
| Example 2 | Button B | 0.3 | — | 0.3 | 113-128 | — | ○ | Absence |

While certain specific working examples have been disclosed herein, the invention may be embodied in other specific forms without departing from the spirit or essential characteristics thereof. The described examples are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

Since the present invention allows the manufacture of a whitish button, which has heretofore been obtained only by plating, by a plating-free method simply and at low cost, it may be applicable to buttons of various forms.

The International Application PCT/JP2007/065260, filed Aug. 3, 2007, describes the invention described hereinabove and claimed in the claims appended hereinbelow, the disclosure of which is incorporated here by reference.

What is claimed is:

1. A button which comprises a button body (10, 10*a*, 10*b*) and a fastener (20, 20*a*, 20*b*) adapted to be arranged on the side of cloth (30) opposite to the side thereof on which said button body is set in place to nip the cloth therebetween and to fixedly secure the button body to the cloth, said button body containing an outer shell member (13), which comprises a button back (15, 15*a*, 15*b*) and a cap (14, 14*a*, 14*b*), and an insert (11, 11*a*, 11*b*) accommodated in the outer shell member, characterized in that all of said button back (15, 15*a*, 15*b*), said cap (14, 14*a*, 14*b*) and said insert (11, 11*a*, 11*b*) are made of an aluminum alloy, wherein a side portion (B) of said button back (15, 15*a*, 15*b*) has the Vickers hardness of Hv 110-140, and wherein a portion of said button back (15, 15*b*) with which said fastener (20, 20*b*) comes into contact has the Vickers hardness of Hv 80-105.

2. The button according to claim 1, wherein said button back (15, 15*a*, 15*b*) is made of an aluminum alloy containing 3-6% by weight of magnesium.

3. The button according to claim 1, wherein said button back (15, 15*a*, 15*b*) has a cross-sectional thickness in the range of 0.25-0.6 mm.

* * * * *